US009527334B2

(12) United States Patent
Heeren

(10) Patent No.: US 9,527,334 B2
(45) Date of Patent: Dec. 27, 2016

(54) FORMING A STAPLE OR CLIP FOR POST-PROCESSING DEVICE

(71) Applicant: OCE-TECHNOLOGIES B.V., Venlo (NL)

(72) Inventor: Theodorus A.G. Heeren, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/567,868

(22) Filed: Dec. 11, 2014

(65) Prior Publication Data

US 2015/0089788 A1 Apr. 2, 2015

Related U.S. Application Data

(63) Continuation of application No. PCT/EP2013/060735, filed on May 24, 2013.

(30) Foreign Application Priority Data

Jun. 14, 2012 (EP) ..... 12171894

(51) Int. Cl.

| | |
|---|---|
| ***B65H 37/04*** | (2006.01) |
| ***B42F 1/02*** | (2006.01) |
| ***B27F 7/21*** | (2006.01) |
| ***B42B 4/00*** | (2006.01) |

(52) U.S. Cl.

CPC . *B42F 1/02* (2013.01); *B27F 7/21* (2013.01); *B42B 4/00* (2013.01); *Y10T 29/49863* (2015.01); *Y10T 29/53* (2015.01)

(58) Field of Classification Search

CPC ..... B65H 37/04; G42F 1/02; B27F 7/21; B42B 4/00

USPC ..... 270/58.07, 58.08, 58.09

See application file for complete search history.

(56) References Cited

U.S. PATENT DOCUMENTS

| | | | | |
|---|---|---|---|---|
| 4,318,555 | A * | 3/1982 | Adamski et al. | 227/7 |
| 5,106,066 | A * | 4/1992 | Shea et al. | 270/37 |
| 5,938,388 | A * | 8/1999 | Bloser et al. | 412/1 |
| 5,996,314 | A * | 12/1999 | Pennini et al. | 53/399 |

(Continued)

FOREIGN PATENT DOCUMENTS

DE 10 2004 040 851 A1 11/2005

OTHER PUBLICATIONS https://www.ahdictionary.com/word/search.html?q=clip[Dec. 9, 2015 12:33:59 PM].*

*Primary Examiner* — Patrick Mackey

(74) *Attorney, Agent, or Firm* — Birch, Stewart, Kolasch & Birch, LLP

(57) ABSTRACT

A method is provided for retaining a stack of sheets in a post-processing unit which improves retaining capabilities of a retaining element while retaining a stack of sheets. This method comprises the steps of forming a stack of sheets, providing a wire from a wire source, the wire being plastically-elastically deformable, selecting a retaining element type from one of a clip element type and a stapling element type, determining a wire deforming program for forming a retaining element of the selected retaining element type, forming the retaining element according to the wire deforming program by bending the wire at a number of positions along the wire and cutting the wire, and applying the formed retaining element to the stack of sheets, thereby retaining the stack.

15 Claims, 13 Drawing Sheets

(56) References Cited

U.S. PATENT DOCUMENTS

| | | | | |
|---|---|---|---|---|
| 6,044,546 | A * | 4/2000 | Yoshie | B42B 5/06 270/58.08 |
| 6,112,939 | A * | 9/2000 | Yoshie | B27F 7/38 221/197 |
| 6,321,935 | B1 * | 11/2001 | Yoshie | B42F 1/003 221/197 |
| 6,557,842 | B2 * | 5/2003 | Conard-White et al. | 270/58.09 |
| 6,739,492 | B1 * | 5/2004 | Adams et al. | 227/82 |
| 6,871,768 | B2 * | 3/2005 | Adams et al. | 227/82 |
| 6,923,360 | B2 * | 8/2005 | Sesek et al. | 227/82 |
| 2011/0236103 | A1 | 9/2011 | Sugiyama | |
| 2012/0047698 | A1 | 3/2012 | O'Daniel | |

* cited by examiner

FORMING A STAPLE OR CLIP FOR POST-PROCESSING DEVICE

CROSS-REFERENCE TO RELATED APPLICATIONS

This application is a Continuation of International Application No. PCT/EP2013/060735, filed on May 24, 2013, and for which priority is claimed under 35 U.S.C. §120. PCT/EP2013/060735 claims priority under 35 U.S.C. §119(a) to application Ser. No. 12/171,894.4, filed in Europe on Jun. 14, 2012. The entire contents of each of the above-identified applications are hereby incorporated by reference into the present application.

BACKGROUND OF THE INVENTION

1. Field of the Invention

The present invention relates to a method for retaining a stack of sheets in a post-processing unit. The present invention further relates to an apparatus for retaining a stack of sheets. The present invention further relates to a clip element for retaining a stack of sheets.

2. Description of Background Art

In a known post-processing unit, a finishing device is provided for automatically binding or clamping a stack of sheets together. The known finishing device contains a stapling unit for applying a staple, which is taken from a staple storage enclosure, onto the stack of sheets, and further contains a clip fitting unit for applying a clip, which is taken from a clip storage enclosure, onto the stack of sheets. The operator can choose whether the stack of sheets is to be stapled or to be clipped. In the known printing system, the shape of the staple element and clip element is restricted to the ones which are provided in the staple storage enclosure and the clip storage enclosure. Regularly, only one shape is provided in each of the storage enclosures of the finishing device; a conventional staple element is provided having a shape for providing a common binding distance and a conventional clip element is provided having a conventional clip shape for common use. However, if a stack of sheets varies in certain aspects, such as thickness and surface properties, a selection of another shape for a staple element and a clip element is desirable in order to optimize binding strengths, ease of use of the binding element and reusability of the sheets of the stack.

SUMMARY OF THE INVENTION

In an aspect of the present invention, a method is provided for retaining a stack of sheets in a post-processing unit, which improves retaining capabilities of a retaining element while retaining a stack of sheets.

This method for retaining a stack of sheets in a post-processing unit comprises the steps of:

a) forming a stack of sheets;

b) providing a wire from a wire source, the wire being plastically-elastically deformable;

c) selecting a retaining element type from one of a clip element type and a stapling element type;

d) determining a wire deforming program for forming a retaining element of the retaining element type selected in step c);

e) forming the retaining element according to the wire deforming program by bending the wire at a number of positions along the wire and cutting the wire; and f) applying the formed retaining element to the stack of sheets, thereby retaining the stack of sheets.

In step a) a stack of sheets is formed. An attribute of the stack of sheets may be determined after step a). Such an attribute of the stack of sheets may comprise, e.g. a thickness of the stack of sheets, a position of the stack of sheets, an area of the stack of sheets, etc.

The attribute may be measured, may be estimated, e.g. may be estimated based on a predetermined number of sheets in the stack of sheets, or may be determined in any other way.

In step b) a wire is provided from a wire source. The wire is plastically-elastically deformable. The wire may be a metal wire, a plastic wire or made out of any other material that is plastically-elastically deformable. The wire may be plastically-elastically deformable by applying at least one of pressure and heat. The wire source may be a wire enclosed in a container, may be a wire roll provided on a reel, or may be provided in any other way.

In step c) a retaining element type is selected from one of a clip element type and a stapling element type. The selection may be made automatically by a control unit. The control unit may automatically make the selection based on attributes of the stack of sheets. For example, the selection may be based on a thickness of the stack of sheets. In another example, a clip element type may be selected in case a stack of sheets comprises a reusable sheet.

A selection of the retaining element type may be performed based upon an operator input. The operator input may be performed at a local user interface or may be performed on a computer interface that is connected to the control unit. The control unit may provide a proposal for a selection to the user interface of the operator, which selection the operator may decide to accept or adjust.

In step d), a wire deforming program is determined for forming a retaining element of the retaining element type being selected. The wire deforming program comprises a number of shape attributes of the retaining element. The number of shape attributes may comprise a number of bends, a bending angle of each of the number of bends, a length of the wire between each two adjacent bends along the wire and a length of the wire between an end of the wire and an adjacent bend along the wire.

The wire deforming program further comprises a number of processing steps for deforming the wire in order to provide the number of shape attributes of the retaining element. The processing steps for deforming the wire is based on the manufacturing processes provided by a wire deforming unit in which the bending and cutting steps will be performed.

In step e), the retaining element is formed according to the wire deforming program by bending the wire at a number of positions along the wire and cutting the wire. The retaining element is formed in a wire deforming unit. The wire may be fed from the wire source into a bending section of the wire deforming unit. For example, the wire may be transported in a main transport direction and may be bent with respect to the main transport direction over an outer surface of a bend forming element, thereby providing a first bend in a first bend forming direction.

In step f), the formed retaining element is applied to the stack of sheets, thereby retaining the stack of sheets. A stapling element may be applied by a staple driving unit thereby stapling the stack of sheets. A clip element may be applied by a clip driving unit thereby clamping the stack of sheets.

A position of the retaining element with respect to the stack of sheets may be configurable. For example a position of the stapling element or the clip element may be adjusted depending on a size of the retained element, which is formed in step e).

The method according to the present invention is able to optimize binding capabilities, ease of use of the retaining element and reusability of the sheet of the stack. The stapling element and the clip element and the shape attributes of the retaining element may be selected based on knowledge of the stack of sheets, which is to be retained.

In an embodiment of the method, in step d), the wire deforming program is based on a thickness of the stack of sheets formed in step a). For example, a clamping force of a clip element may be optimized based on the knowledge of the thickness of the stack of sheets. In another example, a protrusion length of a stapling element may be optimized based on the knowledge of the thickness of the stack of sheets, e.g. a length of the wire between an end of the wire and an adjacent bend along the wire may be adjusted.

In another embodiment of the method, in step c) a clip element type is selected and wherein step d) further comprises selecting a shape attribute of the clip element based on the stack of sheets formed in step a) and based on a predetermined clamping force, wherein the shape attribute of the clip element comprises at least one of a number of bends, a bending angle of each of the number of bends and a length of the wire between each two adjacent bends along the wire.

In a particular embodiment of the method, in step d), a first length of the wire between two adjacent bends is selected based on a thickness of the stack of sheets formed in step a). For example, the clamping force of the clip element may be optimized by adjusting the first length of the wire between two adjacent bends depending on the thickness of the stack of sheets. A portion of the wire having said first length may be a bending portion of the clip which, while being applied to the stack of sheets, is oriented in the direction of the thickness of the stack of sheets, or may be a torsional portion of the clip which, while being applied to the stack of sheets, is oriented perpendicular to the direction of the thickness of the stack of sheets. Both the bending portion and the torsional portion contribute to a clamping force of the clip element.

In another embodiment of the method, in step c), a stapling element is selected, and wherein step d) further comprises selecting a shape attribute of the stapling element based on a thickness of the stack of sheets formed in step a), wherein the shape attribute of the stapling element comprises at least one of a length of the wire between two adjacent bends along the wire and a length of the wire between an end of the wire and an adjacent bend along the wire.

In another embodiment of the method, step c) further comprises selecting the retaining element type based on an operator input. An advantage of selecting the retaining element type based on an operator input is taking into account user considerations or requirements, which are not known to the control unit. The control unit, which may perform the selection step, may have limited knowledge regarding the stack of sheets, the material composition and properties of the sheets, the use of the sheets, a desired clamping force, etc.

In another embodiment of the method, step d) further comprises selecting a shape attribute of the retaining element based on an operator input indicating a configurable shape attribute. An advantage of selecting a shape attribute of the retaining element based on an operator input is taking into account user considerations or requirements, which are not known to control unit.

In one example, an operator may select a dimension of a clip element in relation to a direction perpendicular to the thickness of the stack of sheets in a retaining state of the clip element.

In another example, a control unit may propose various designs of the retaining element to an operator, each of the designs comprising a number of shape attributes, and the operator may select one of the various designs of the retaining element which are proposed.

In a particular embodiment of the method, in step e), the wire is transported in the main transport direction by means of a transport pinch, which transport pinch is provided by two transport rollers, and wherein the bend forming element is one of the two transport rollers. The wire may also be bent with respect to the main transport direction over an outer surface of the other one of the two transport rollers, thereby providing a second bend in a second bend forming direction. The embodiment provides a simple process for bending the wire at a number of positions along the wire.

In a particular embodiment of the method, step e) further comprises temporarily bending a portion of the wire, which portion is downstream of the bend forming element with respect to the main transport direction, in a direction having an angle with respect to the plane that is defined by the main transport direction and the first bend forming direction. Temporarily bending the portion of the wire may be performed by elastically bending the wire at a predetermined position with respect to the bend forming element. Alternatively, temporarily bending the portion of the wire may be performed by plastically bending the portion of the wire at a position along the wire, performing a number of bending steps along the wire, and subsequently plastically removing the temporarily bend (i.e. in a de-bending step) at the same position along the wire.

The embodiment supports a simple process for forming a plurality of bends by using the bend forming element, wherein the resulting retaining element comprises wire portions which, after the forming process, are at least partly arranged on top of each other.

In another embodiment of the method, the stack of sheets formed in step a) comprises at least one reusable sheet, and wherein in step c), the clip element type is selected.

In case a reusable sheet is used, it is desirable to retain the stack of sheets without damaging the reusable sheet in order to enable reuse of the reusable sheet. The selection of the clip element type prevents damage to the reusable sheet, which may be caused by a protruding binding element type, such as a stapling element type.

In another aspect of the invention, an apparatus for a retaining a stack of sheets is provided, wherein the apparatus comprises:

a) a stack forming unit for forming a stack of sheets;

b) a wire source for storing a wire, the wire being plastically-elastically deformable;

c) a selection unit for selecting a retaining element type from one of a clip element type and a stapling element type;

d) a wire deforming unit configured for, in operation, forming a retaining element of the selected retaining element type by bending and cutting the wire according to a wire deforming program;

e) a retaining unit for applying the formed retaining element to the stack of sheets; and f) a control unit for controlling the stack forming unit, the selection unit, the wire deforming unit and the retaining unit for retaining the stack of sheets, wherein the control unit determines the wire deforming program for the wire deforming unit.

The apparatus is able to provide optimized binding capabilities of the retaining element, ease of use of the retaining element and reusability of the sheet of the stack. The stapling element and the clip element and the shape attributes of the retaining element may be selected based on knowledge of the stack of sheets, which is retained by the retaining element.

In another embodiment of the apparatus, the apparatus further comprises a sensor for determining a thickness of the stack of sheets, and wherein the control unit determines the wire deforming program based on a sensor signal provided by the sensor to the control unit indicating the thickness of the stack of sheets.

In another embodiment of the apparatus, the apparatus further comprises a user interface comprising a previewing device for indicating to an operator at least one of a user selectable retaining element type and a configurable shape attribute of the retaining element and an input device for receiving at least one of an operator input regarding the retaining element type and an operator input regarding the configurable shape attribute of the retaining element. The user interface supports an on-demand selection of retaining element type and shape attribute and thereby improves the quality of retaining the stack of sheets.

In another embodiment of the apparatus, the wire deforming unit comprises a transport pinch, comprising two transport rollers, for transporting the wire in a main transport direction, and a wire deforming element for bending the wire over an outer surface of one of the two transport rollers in a first bend forming direction and over an outer surface of the other one of the two transport rollers in a second bend forming direction.

The embodiment provides a simple construction for bending the wire at a number of positions along the wire.

In another embodiment of the apparatus, the retaining unit comprises a staple driving unit for stapling the stack of sheets and a clip driving unit for clamping the stack of sheets by applying the clip element.

In another embodiment of the apparatus, the apparatus further comprises a detector, which is configured to detect the stacking of a reusable sheet in the stack forming unit, wherein the detector is configured, in case a reusable sheet is detected, to send a signal to the selection unit, upon which signal the selection unit automatically selects the clip element type.

The detector may be arranged inside the stack forming unit in order to detect the stacking of the reusable sheet. In an alternative embodiment, the detector may detect the supply of the reusable sheet towards the stack forming unit prior to the stacking of the reusable paper in the stack forming unit.

In case a reusable sheet is detected, it is desirable to retain the stack of sheets without damaging the reusable sheet in order to enable reuse of the reusable sheet. The selection of the clip element type prevents damage to the reusable sheet, which may be caused by a protruding binding element type, such as a stapling element type.

Further, a method is provided for retaining a stack of sheets in a post-processing unit, the method comprising the steps of forming a stack of sheets, providing a wire from a wire source, the wire being plastically-elastically deformable, determining a wire deforming program for forming a clip element, forming the clip element according to the wire deforming program by bending the wire at a number of positions along the wire and cutting the wire, and applying the formed clip element to the stack of sheets, thereby retaining the stack of sheets.

Further, an apparatus for a retaining a stack of sheets is provided, wherein the apparatus comprises a stack forming unit for forming a stack of sheets, a wire source for storing a wire, the wire being plastically-elastically deformable, a wire deforming unit configured for in operation forming a clip element by bending and cutting the wire according to a wire deforming program a retaining unit for applying the formed clip element to the stack of sheets, and a control unit for controlling the stack forming unit, the selection unit, the wire deforming forming unit and the retaining unit for retaining the stack of sheets, wherein the control unit determines the wire deforming program for the wire deforming unit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1A:
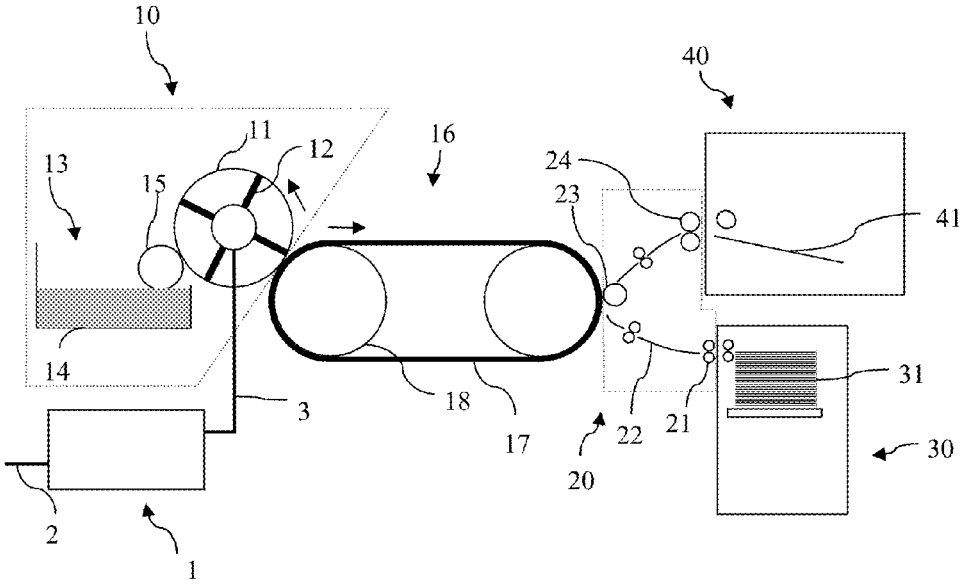
FIG. 1A is a schematic view of a toner print engine.

The present invention will now be described with reference to the accompanying drawings, wherein the same reference numerals have been used to identify the same or similar elements throughout the several views.

FIG. 1A shows a print engine for printing images. The print engine comprises a converter 1 to convert image data into a print signal, an image forming module 10 to apply marking material corresponding to the print signal, the marking material being brought in contact with the image forming element 11 by a developing unit 13, an intermediate member 16 for transferring the marking material to the image fixing module 20, an image receiving member input station 30 for bringing in an image receiving member, usually sheet media, and a delivery station 40 for receiving the finished output product. In this embodiment, the marking material is conventionally toner, which comprises a resin that is softened by heat.

The image data are supplied to the print engine through a data connection 2. This may be any suitable data connection, depending among other things on the required bandwidth. The converter 1 comprises electronic circuits including programmable logic to convert an image line into a print signal that is suitable to be applied to the image forming module 10 through a data connection 3. In FIG. 1A, the image forming module 10 comprises a rotatable, substantially cylindrically shaped image forming element 11 having an electronic device 12 in the inside to apply a voltage on conductive tracks under a dielectric layer on an outer surface of the image forming element 11. This voltage induces a local electric field outside the image forming element 11 that attracts toner particles from developing roller 15 that receives the toner particles from a toner supply unit 14. In this way, an image of toner particles is formed on the surface of the image forming element 11.

Alternatively, the image forming element 11 may comprise a roller with a photoconductive layer on the outside surface of the roller. In such embodiment, the surface of the photoconductive layer is charged by, e.g. a corona and the print signals are applied to an imaging unit outside the roller. The imaging unit may comprise a LED-bar, or a laser scan module, that locally illuminates the layer to conform the image to be printed. The photoconductivity of the layer results in a locally discharged surface. The parts of the photoconductive layer that remain charged may be used to attract toner from a toner roller like developing roller 15 by creating an electric field between these charged parts and the toner roller. In an embodiment, an electric field between the charged parts and the toner roller may be provided by connecting the toner roller to a ground voltage. The toner may comprise electrically conductive particles having a specified color or a mixture of isolating colored particles and carrier particles that charge the isolating particles, making them sensitive to an electric field between the developing roller and the image forming element. Instead of carrier particles, the developing roller may also be supplemented by a contact roller that charges the toner particles. Therefore, there are various ways to obtain an image of toner particles on the surface of the image forming element. In the process of forming the image, the element rotates in the direction indicated by the arrow in FIG. 1A. It is further noted that in another embodiment, an imaging forming element is formed by arranging a belt with a photoconductive layer on several rollers.

The intermediate member 16 comprises a belt 17 and two guiding rollers 18, but more rollers are also possible. The belt 17 rotates in congruence with the image forming element 11 and receives the toner image in a nip where the image forming element 11 and the belt 17 are in contact. The transfer of toner may take place by the influence of mechanical forces that are induced when the top layer of the belt comprises an elastic, adhesive material, such as rubber, or by the influence of electric forces that originate from a voltage difference between the image forming element and the belt. The intermediate member 16 may further comprise a heating unit, which is not shown in FIG. 1A, to control the temperature of the belt. Although only one image forming element is shown in FIG. 1A, the intermediate member may be configured to have several image forming elements around it, each for a different process color of toner particles that are collected on the belt. In this way, a full color image may be formed, e.g. by the process colors cyan, magenta, yellow and black. The intermediate member may also be configured as a drum with an outer layer that is suitable to collect the various color particles.

The image fixing module 20 is able to transport an image receiving member, such as a sheet of paper, by transport rollers 21 and a guide 22 to a pressure roller 23 that brings the image receiving member into contact with the belt 17 of the intermediate member 16. The image receiving member is supplied by an image receiving member input station 30 comprising a pile of sheets 31. By applying heat and pressure, the toner is brought onto the image receiving member, which is transported further towards the post processing unit 40. The image fixing module may comprise a path for turning the image receiving member to be able to print another side. The fusing rollers 24 raise the temperature of the image receiving member to further fix the printed image on the image receiving member and to enhance the printed image quality. When the temperature of the pressure roller 23 is sufficiently high, no fusing rollers are necessary.

The post processing unit 40 comprises a support tray 41, on which different sheets may be stacked, but may also comprise a stapler, a hole puncher, etc. for performing a post processing step. The various modules are controlled by a control unit to have their actions coordinated.

Figure 1B:
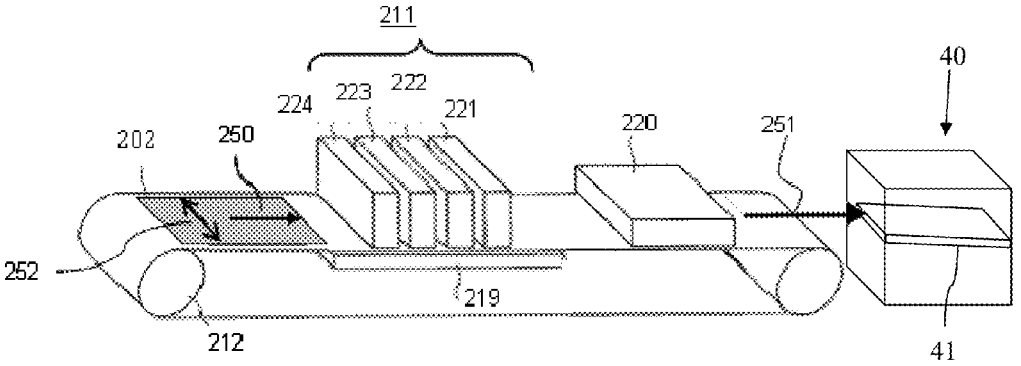
FIG. 1B illustrates a cut sheet inkjet printing module.

FIG. 1B illustrates a cut sheet inkjet printing module. FIG. 1B shows that a sheet of a receiving medium 202 is transported in a direction for conveyance as indicated by arrows 250 and 251 and with the aid of transportation mechanism 212. Transportation mechanism 212 may be a driven belt system comprising one (as shown in FIG. 1) or more belts. Alternatively, one or more of these belts may be exchanged for one or more drums. A transportation mechanism may be suitably configured depending on the requirements (e.g. sheet registration accuracy) of the sheet transportation in each step of the printing process and may hence comprise one or more driven belts and/or one or more drums. For a proper conveyance of the sheets of receiving medium, the sheets need to be fixed to the transportation mechanism. The way of fixation is not particularly limited and may be selected from electrostatic fixation, mechanical fixation (e.g. clamping) and vacuum fixation. Of these vacuum fixation is preferred.

In FIG. 1B, 211 represents an inkjet marking module comprising four inkjet marking devices, indicated with 221, 222, 223 and 224, each arranged to eject an ink of a different color (e.g. Cyan, Magenta, Yellow and black). The nozzle pitch of each head is, e.g. about 360 dpi. In the present invention, "dpi" indicates a dot number per 2.54 cm.

An inkjet marking device for use in single pass inkjet printing, 221, 222, 223 and 224, has a length, L, of at least the width of the desired printing range, indicated with double arrow 252, the printing range being perpendicular to the media transport direction, indicated with arrows 250 and 251. The inkjet marking device may comprise a single print head having a length of at least the width of said desired printing range. The inkjet marking device may also be constructed by combining two or more inkjet heads, such that the combined lengths of the individual inkjet heads cover the entire width of the printing range. Such a constructed inkjet marking device is also termed a page wide array (PWA) of print heads.

In image formation by ejecting an ink, an inkjet head (i.e. print head) employed may be either an on-demand type or a continuous type inkjet head. As an ink ejection system, there may be usable either the electric-mechanical conversion system (e.g., a single-cavity type, a double-cavity type, a bender type, a piston type, a shear mode type, or a shared wall type), or an electric-thermal conversion system (e.g., a thermal inkjet type, or a Bubble Jet type (registered trade name)). Among them, it is preferable to use a piezo type inkjet recording head which has nozzles of a diameter of 30 μm or less in the current image forming method.

FIG. 1B shows that, after a pre-treatment step (not shown), the receiving medium 202 is conveyed to an upstream part of the inkjet marking module 211. Then, image formation is carried out by each color ink ejecting from each inkjet marking device 221, 222, 223 and 224, arranged so that the whole width of the receiving medium 202 is covered.

Optionally, the image formation may be carried out while the receiving medium is temperature controlled. For this purpose, a temperature control device 219 may be arranged to control the temperature of the surface of the transportation mechanism (e.g. belt or drum) underneath the inkjet marking module 211. The temperature control device 219 may be used to control the surface temperature of the receiving medium 202, for example in the range of 30° C. to 60° C. The temperature control device 219 may comprise heaters, such as radiation heaters, and a cooler, for example a cold blast, in order to control the surface temperature of the receiving medium within said range. Subsequently and while printing, the receiving medium 202 is conveyed to the downstream part of the inkjet marking module 211.

FIG. 1B schematically shows a drying and fixing unit 220, which may comprise a heater, for example a radiation heater. After an image has been formed, the print is conveyed to and passed through the drying and fixing unit 220. The print is heated such that solvents present in the printed image, to a large extent water, evaporate. The speed of evaporation and hence drying may be enhanced by increasing the air refresh rate in the drying and fixing unit 220. Simultaneously, film formation of the ink occurs, because the prints are heated to a temperature above the minimum film formation temperature (MFT). The residence time of the print in the drying and fixing unit 220 and the temperature at which the drying and fixing unit 220 operates are optimized, such that when the print leaves the drying and fixing unit 220, a dry and robust print has been obtained. As described above, the transportation mechanism 212 in the fixing and drying unit 220 may be separated from the transportation mechanism of the pre-treatment and printing section of the printing apparatus and may comprise a belt or a drum.

FIG. 1B further shows a post processing unit 40 comprising a support tray 41, on which different sheets may be stacked, but may also comprise a stapler, a hole puncher, etc. for performing a post processing step. The various modules are controlled by a control unit to have their actions coordinated.

The present invention may be employed in the toner print engine illustrated in FIG. 1A, in the cut sheet inkjet print module illustrated in FIG. 1B, and in any other post processing unit for retaining a stack of sheets.

Figure 2A:
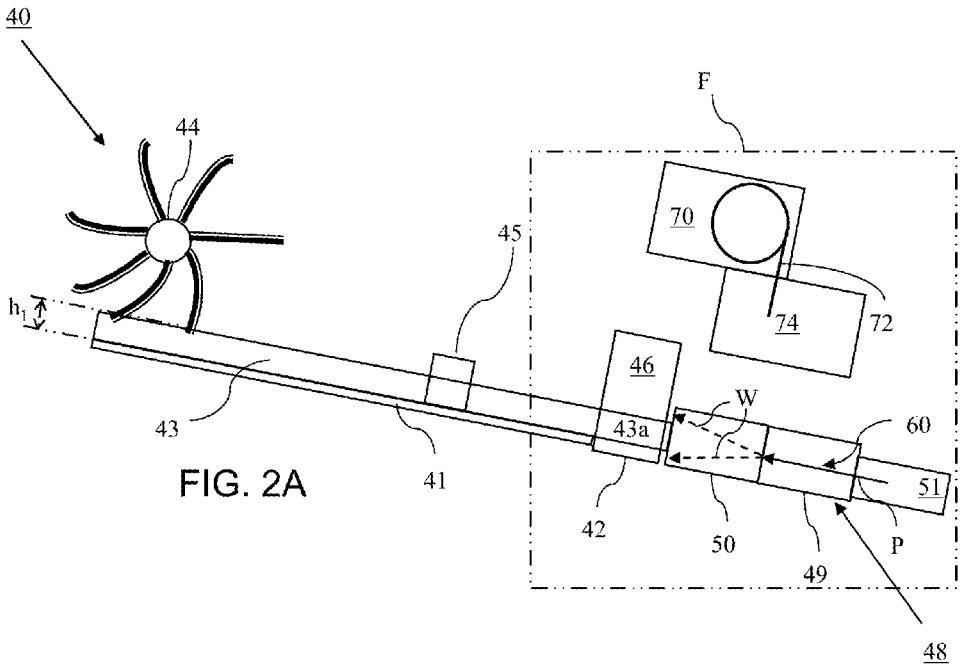
FIG. 2A shows a post processing unit for retaining a stack of sheets according to the present invention.

FIG. 2A shows a post processing unit for retaining a stack of sheets according to the present invention. In FIG. 2A, the post processing unit 40 comprises a support tray 41. A stack of sheets 43 is formed by rotating a stack forming roller 44, such as a brush roller, supported by the support tray 41. The support tray 41 has at a first end 42 an open area below an edge portion of the stack of sheets 43*a*. The post processing unit further comprises a stack pushing unit 45 for aligning the edge portion of the stack of sheets 43*a* with respect to a stapling driving unit 46 prior to applying a stapling element. The stapling driving unit 46 is configured for applying the stapling element onto the edge portion of the stack of sheets 43*a*.

The post processing unit further comprises a clip applying unit 48. The clip applying unit 48 comprises a clip storage enclosure 49 for storing one or more clip elements, a clip pushing element 51 for moving a clip element 60, which is retained by the clip storage enclosure 49, towards the edge portion of the stack of sheets 43*a* (as indicated by arrow P) and a clip travel unit 50 for guiding the clip element while the clip element is moved towards the edge portion of the stack of sheets 43*a*. The clip travel unit 50 is configured for simultaneously guiding the clip element towards the edge portion of the stack of sheets 43*a* and moving at least one of a first part of the clip element 60 upwards and a second part of the clip element 60 downwards with respect to the edge portion of the stack of sheets 43*a* thereby following a clip travel path as indicated by dashed lines W, such that the applied clip element clamps the edge portion of the stack of sheets 43*a*.

The post processing unit further comprises a wire source 70, which is operatively connected to a wire deforming unit 74. A wire 72 is supplied by the wire source to the wire deforming unit 74.

Figure 2B:
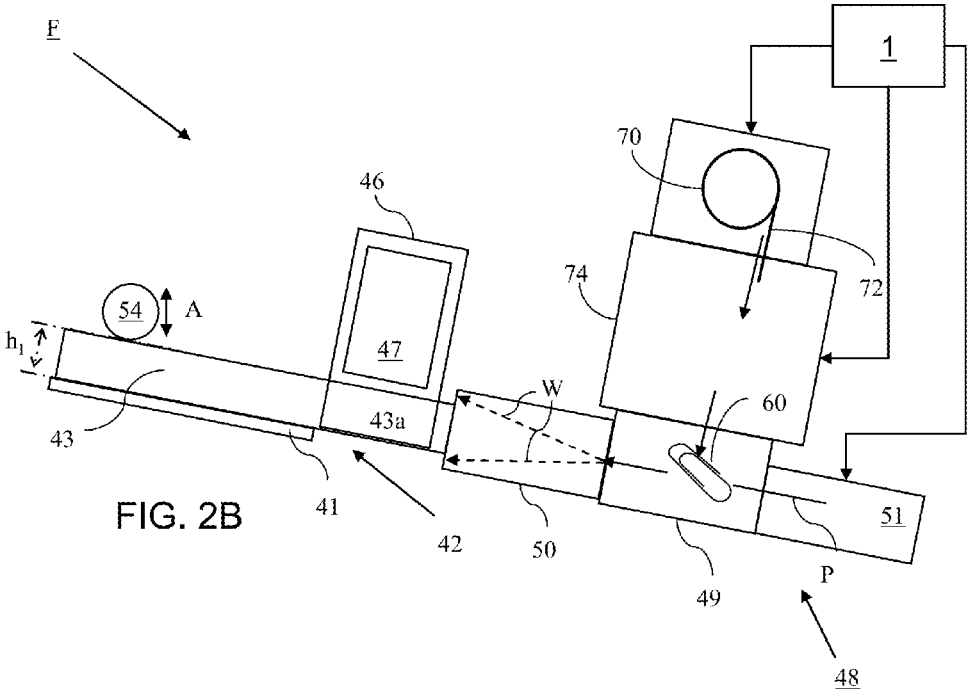
FIG. 2B shows an enlarged part of the post processing unit for retaining a stack of sheets according to a first embodiment.

FIG. 2B shows a detail F of the post processing unit 40 in FIG. 2A according to a first embodiment. FIG. 2B shows the stack of sheets 43 being supported by the support tray 41. The support tray 41 has at the first end 42 an open area below an edge portion of the stack of sheets 43*a*. The stapling driving unit 46 comprises a staple storage enclosure 47 for storing a stack of stapling elements. The stapling driving unit 46 is configured for applying a stapling element of the stack of stapling elements onto the edge portion of the stack of sheets 43*a*.

A wire source 70 is operatively connected to a wire deforming unit 74 for supplying a wire 72 towards the wire deforming unit 74. A wire deforming program is determined by the control unit 1 and provided to the wire deforming unit 74. In the wire deforming unit 74 a clip element 60 is formed according to the wire deforming program. The wire deforming unit 74 is operatively connected to a clip driving unit 48. The clip driving unit 48 comprises a clip storage enclosure 49 for storing one or more clip elements, a clip pushing element 51 and a clip travel path 50. The clip element 60, which is formed in the wire deforming unit 74, is supplied to the clip storage enclosure 49. The clip element 60 inside the clip storage enclosure 49 is moved by the clip pushing element 51 towards the edge portion of the stack of sheets 43*a* (as indicated by arrow P). A clip travel path 50 guides the clip element while the clip element is moved towards the edge portion of the stack of sheets 43*a*. The clip travel path 50 is configured for simultaneously guiding the clip element towards the edge portion of the stack of sheets 43*a* and moving at least one of a first part of the clip element 60 upwards and a second part of the clip element 60 downwards with respect to the edge portion of the stack of sheets 43*a*, thereby following a clip travel path as indicated by dashed lines W, such that the applied clip element 60 clamps the edge portion of the stack of sheets 43*a*. The post processing unit further comprises a stack sensor 54, which is movably arranged as indicated by arrow A, for detecting a thickness $h_1$ of the stack of sheets 43.

Figure 2C:
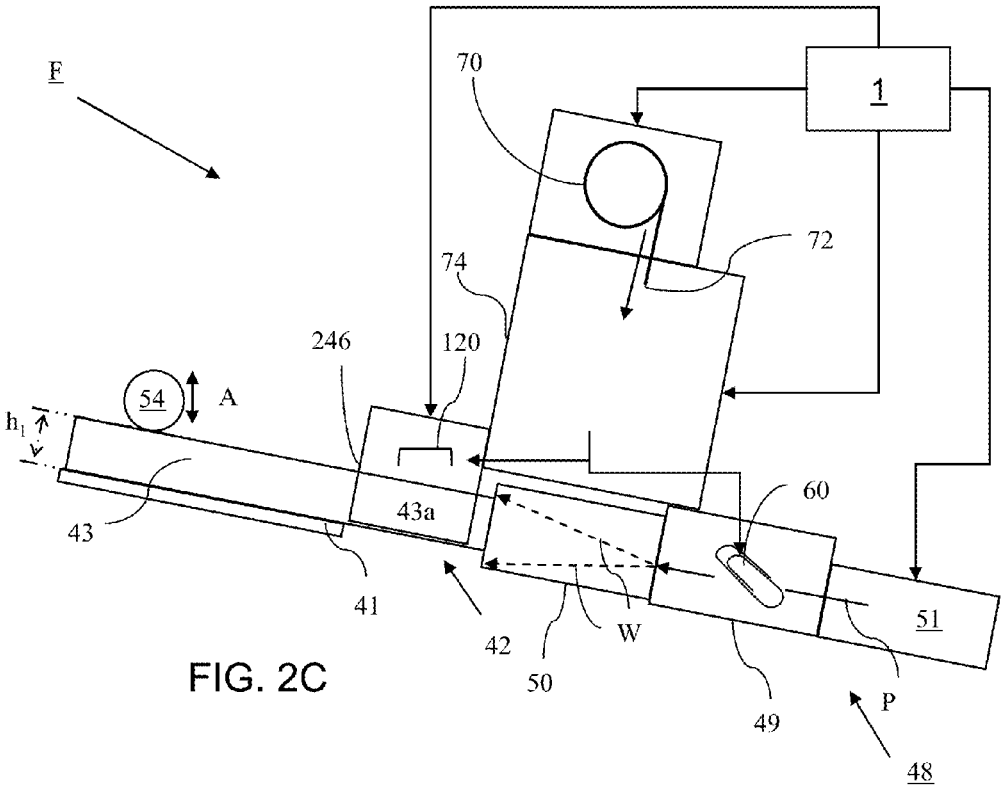
FIG. 2C shows an enlarged part of the post processing unit for retaining a stack of sheets according to a second embodiment.

FIG. 2C shows a detail F of the post processing unit 40 in FIG. 2A according to a second embodiment of the present invention.

A wire source 70 is provided for supplying a wire 72 toward a wire deforming unit 74. The wire deforming unit 74 is operatively connected to a clip driving unit 48 and to a stapling driving unit 246. The control unit 1 comprises a selection unit in which the retaining element type is selected. A wire deforming program is determined by the control unit 1 and provided to the wire deforming unit 74. The wire deforming unit 74 forms one of a stapling element 120 and a clip element 60 according to the wire deforming program. If a clip element 60 is formed in the wire deforming unit 74, the clip element 60 is supplied to the clip storage enclosure 49 of the clip driving unit 48. The clip element 60 is applied to the stack of sheets 43 as described hereinabove. In case a stapling element 120 is formed in the wire deforming unit 74, the stapling element 120 is supplied to the stapling driving unit 246. The stapling element 120 is applied to the stack of sheets 43 as described hereinabove.

It should be noted that the stapling driving unit 246 does not need a staple storage enclosure 47 for storing a stack of stapling elements, since the stapling element 120 is formed on-demand by the wire deforming unit 74. Likewise, the clip driving unit 48 does not need a clip storage enclosure for storing a stack of clip elements, since each clip element 60 is formed on-demand by the wire deforming unit 74.

FIGS. 2D-2G illustrate examples of a clip element for use in the post processing unit of the present invention. Each drawing shows a clip element and, as indicated by an arrow, an arrangement of the clip element after applying the clip element on a stack of sheets.

Figure 2D:
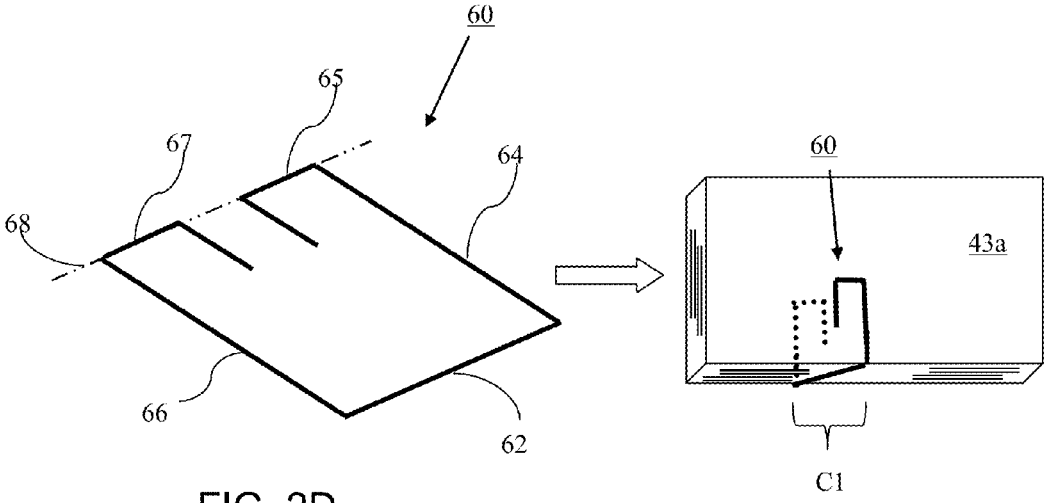
FIGS. 2D-2G illustrate examples of a clip element for use in the post processing unit of the present invention.

FIG. 2D shows the clip element 60 comprises a bridging portion 62, a first deflectable leg 64 and a second deflectable leg 66, both being connected to the bridging portion 62. Each leg 64, 66 is connected to an end portion 65, 67, respectively, of the clip element 60. In an unattached position of the clip element 60, the two end portions 65, 67 are aligned and lie in a common plane 68. To attach the clip element 60 to an edge portion of a stack of sheets, at least one of the two legs 64, 66 is moved out of the common plane 68 and relative to the other end portion, thus allowing space between the legs for inserting an end portion of the stack of sheets. When a stack of sheets 43 is clamped, the legs 64, 66 end up on opposite side of the end portion of the stack of sheets 43*a*.

A clip element 60 is supplied by the wire deforming unit 74 to the clip storage enclosure 49 of the clip applying unit 48 (shown in FIGS. 2B and 2C). The clip element 60 provides a clamping force on the end portion of the stack of sheets 43*a* depending on a thickness $h_1$ of the stack of sheets 43. The clamping force is distributed by the clip element 60 over a clamping width C1 of the clip element 60.

The clip element may be designed in such a way that the stack of sheets are kept bound with adequate clamping force over a suitable clamping width and that due to mounting the clip element onto the stack of sheets, there is no plastic deformation anywhere in the clip-wire. This clamping force depends on the thickness, the dimensioning of the clip element and on the torsional stiffness and bending stiffness properties of each part of the clip element. For example in clip element 60 the areas where the maximum torsional stiffness is accumulated in legs 64, 66 and the bending elastic energy is accumulated in bridging portion 62 of the clip element 60. Using standard Euler beam theory, all forces and bending/torsion moments in each cross section of the paperclip wire can easily be calculated.

Figure 2E:
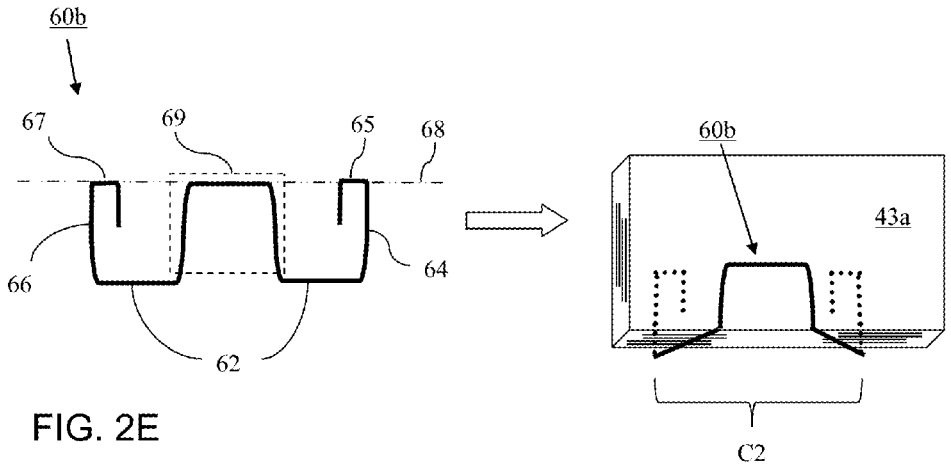

FIG. 2E illustrates a second example of a clip element 60*b*. The clip element 60*b* comprises two bridging portions 62 and additionally comprises a connecting portion 69, which connects the two bridging portions 62. In an unattached position of the clip element 60*b* the two end portions 65, 67 and the connecting portion 69 are aligned and lie in a common plane 68. To attach the clip element 60*b* to an edge portion of a stack of sheets 43*a*, both legs 64, 66 are moved out of the common plane 68 and relative to the connecting portion 69, thus allowing space between both legs and connecting portion 69 for inserting an end portion of the stack of sheets 43*a*. When a stack of sheets 43 is clamped, both legs 64, 66 end up on opposite side of the end portion of the stack of sheets 43*a* with respect to the connecting portion 69. The clamping width C2 of the clip element 60*b* is relatively larger than the clamping width C1 of the clip element 60, shown in FIG. 2D.

Figure 2F:
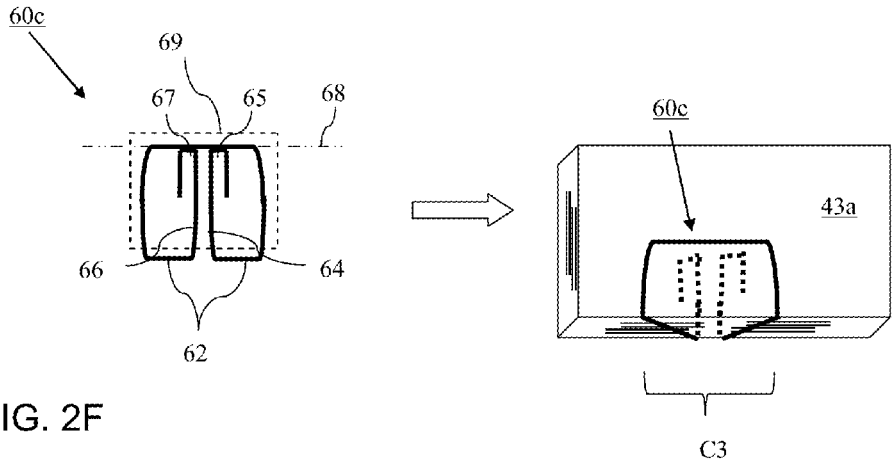

FIG. 2F illustrates a third example of a clip element 60*c*. In clip element 60*c* the two legs 64, 66 are arranged within the clamping area of the connecting portion 69. As a result, when attaching the clip element 60*c* to an edge portion of a stack of sheets 43*a*, the clamping width C3 of the clip element is relatively smaller than the clamping width C2 of clip element 60*b*. The clamping force of clip element 60*c* is substantially equal to the clamping force of the clip element 60*b*.

Figure 2G:
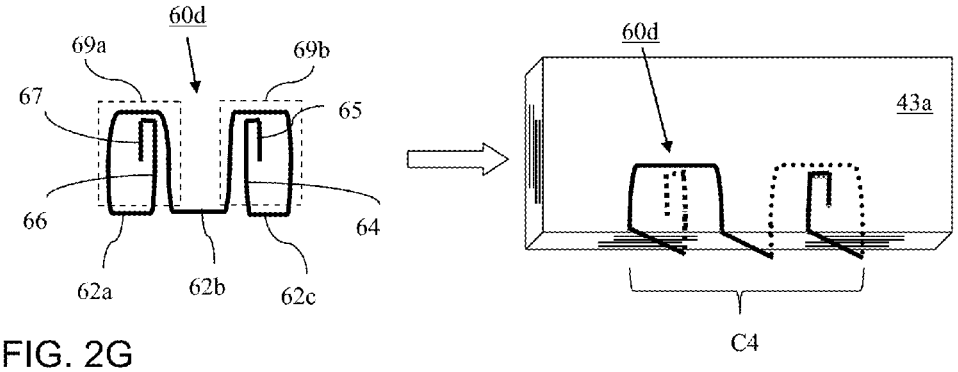

FIG. 2G illustrates a fourth example of a clip element 60*d*. The clip element 60*d* comprises three bridging portions 62*a*, 62*b*, 62*c* and two connecting portion 69*a*, 69*b*. Each of the connecting portions 69*a*, 69*b* connects two adjacent bridging portions 62. The leg 66 is arranged within the clamping area of the connecting portion 69*a* and the leg 64 is arranged within the clamping area of the connecting portion 69*b*. When attaching the clip element 60*d* to an edge portion of a stack of sheets 43*a*, the clip element 60*d* provides a clamping force over a clamping width C4. The legs 64, 66 of the clip element 60*d* end up on opposite side of the end portion of the stack of sheets 43*a*.

As a person skilled in the art will contemplate, other shapes for the clip element may be selected for providing an adequate clamping force over a desired clamping width.

The shape of the paper clip can be described with a limited set of dimensional parameters: straight wire lengths and bending angles. The only other relevant parameters are: wire diameter, Young's modulus and maximum von Mises plasticity stress. Moreover, the thickness of the stack of sheets is known in advance, before producing the clip element 60. The clamping force can now be calculated as the derivative of the total elastic energy in the clip (torsion+bending energy, integrated over the whole wire) with respect to each dimensional parameter. A computer program can be designed, that generates a suitable clip shape for each desired stack thickness and clamping force. For practical feasibility reasons, larger clamping forces may turn out to require larger wire diameters.

Figure 3A:
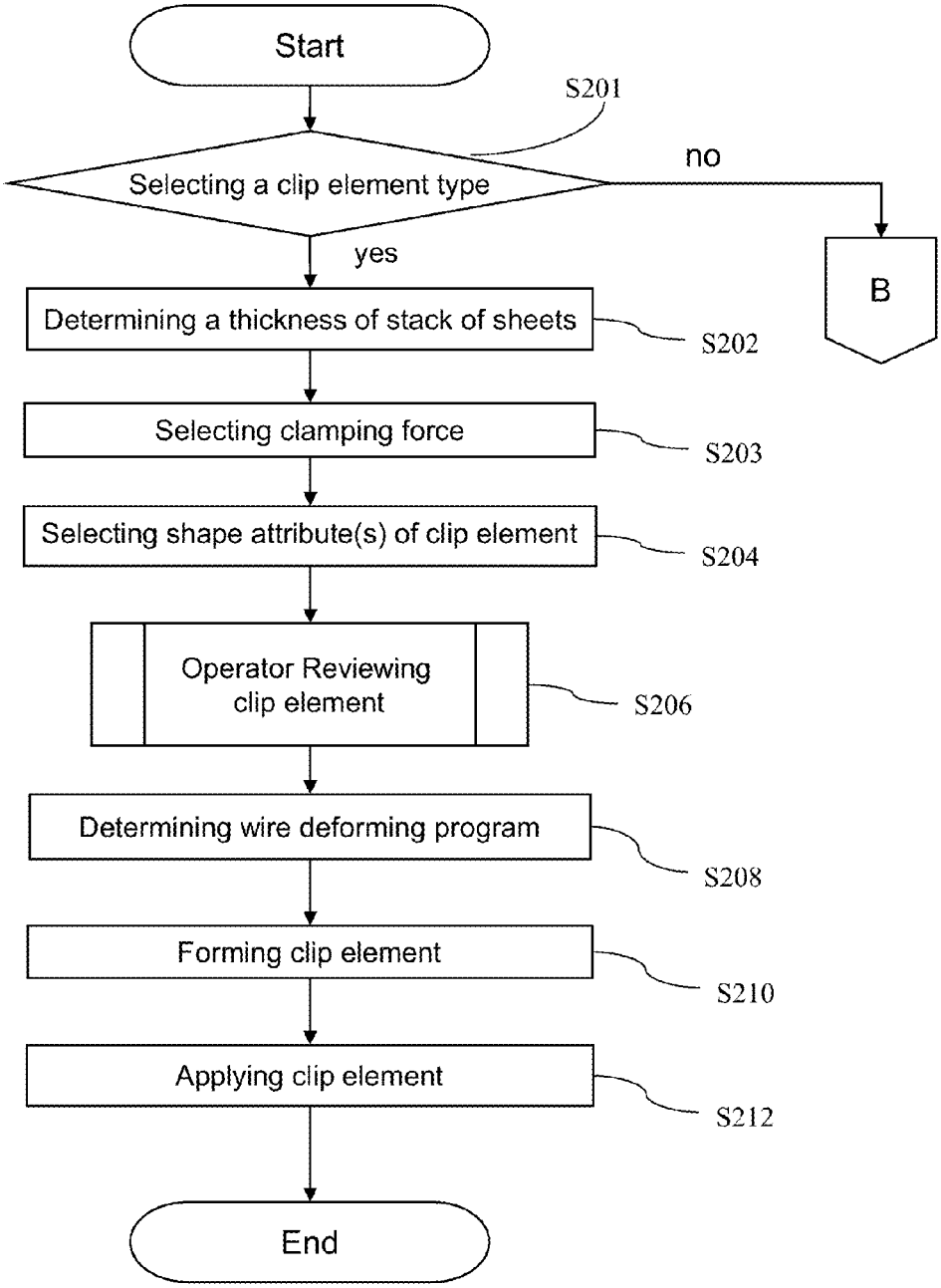
FIG. 3A is a flow chart presenting steps of the invented method, partially by means of a user interface, wherein a clip element type is selected.

FIG. 3A shows a flow chart presenting steps of the invented method, partially by means of a user interface, wherein a clip element type is selected. In step S201 it is judged whether a clip element type is selected. If the clip element type is selected, the flow proceeds towards step S202. If the clip element is not selected, the flow proceeds towards the continued process B shown in FIG. 3B. In step S202, a thickness of the stack of sheets is determined. In step S203 a clamping force is selected. The clamping force is selected upon an operator input. Alternatively, the clamping force may be selected based on a predetermined value. The clamping force may further be selected based on the thickness of the stack of sheets, in order that the clamping force increases with an increasing thickness of the stack of sheets.

In step S204, at least one shape attribute of the clip element is selected. The at least one shape attribute of the clip element is based on the clamping force selected in step S203 and on the thickness of the stack of sheets determined in step S202. The selection in step S204 is further based on wire properties of the wire to be deformed and on wire deforming constraints of a wire deforming unit. Wire properties may, for example, be a wire thickness, an elastic modulus and a yield stress of the wire. Wire deforming constraints may, for example, be a maximum size of a clip element, a maximum length of a wire between two bends of the wire, a maximum bending angle of a bend to be formed, etc.

The selection of the shape attributes in step S204 comprises in different embodiments, respectively, the selection of the number of bends of the clip element, the selection of the angle of at least one bend, and the selection of a length of a clip portion, such as a length of a bridging portion 62 of the clip element.

Figure 3B:
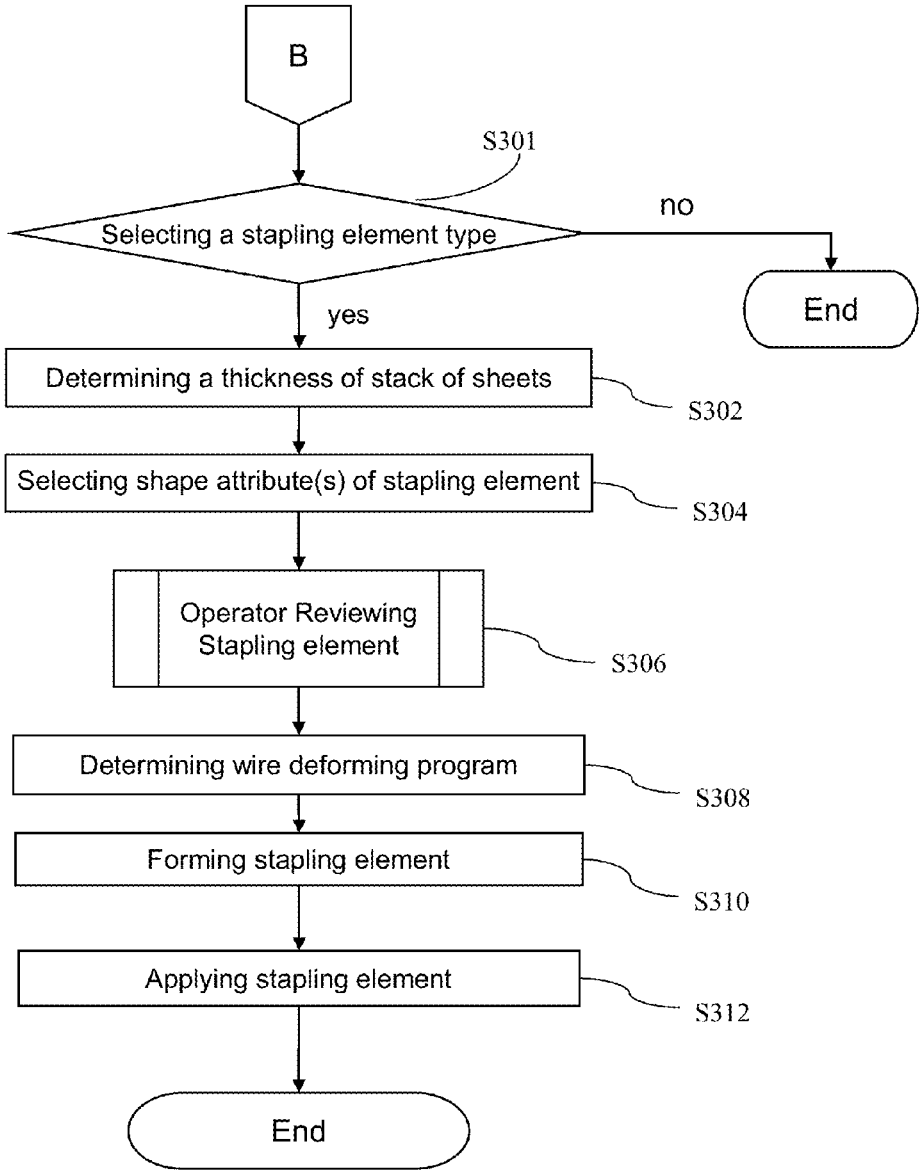
FIG. 3B is a flow chart presenting steps of the invented method, partially by means of a user interface, wherein a stapling element type is selected.
Figure 3C:
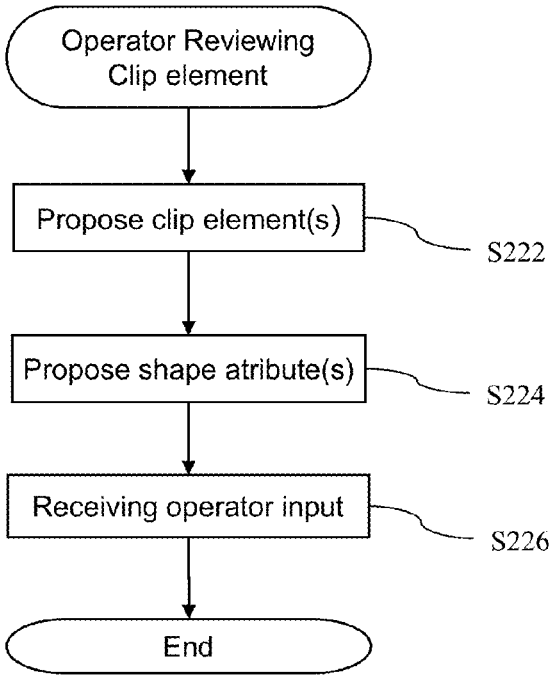
FIG. 3C is a flow chart for an operator reviewing of a clip element.

In step S206, an operator review is carried out as is further illustrated in FIG. 3C. The operator review comprises steps S222, S224 and S226. In step S222, a number of user selectable clip elements is proposed to an operator for review. For example, three selectable clip elements are presented to an operator, which all provide the desired clamping force for the formed stack of sheets. Furthermore, in step S224, a number of configurable shape attribute(s) of the clip element type is presented to an operator for review, such as a length of a bridging portion 62 of the clip element. In step S226, one ore more operator inputs regarding the user selectable clip elements and/or configurable shape attribute of the clip element type are received and processed.

As shown in FIG. 3A, in step S208, a wire deforming program is determined. The wire deforming program is determined based on the selection of at least one shape attribute of the clip element. The wire deforming program contains a number of manufacturing steps for deforming the wire in order to form the clip element, which is selected in step S226.

In step S210, a clip element is formed according to the wire deforming program by bending the wire at a selected number of positions along the wire and cutting the wire. Finally in step S212 the formed clip element formed in step S210 is applied to the stack of sheets, thereby retaining the stack of sheets. Furthermore a position of the clip element with respect to the stack of sheets 43 may be selected by the operator.

FIG. 3B shows a flow chart presenting steps of the invented method, partially by means of a user interface, wherein a stapling element type is selected. In step S301 it is judged whether a stapling element type is selected. If the stapling element type is selected, the flow proceeds towards step S302. In step S302, a thickness of the stack of sheets is determined. In step S304, at least one shape attribute of the stapling element is selected. In step S304, the at least one shape attribute of the stapling element is based on the thickness of the stack of sheets determined in step S302. The selection in step S304 is further based on wire properties of the wire to be deformed and on wire deforming constraints of a wire deforming unit.

In step S304, the selection of the shape attributes comprises in different embodiments, respectively, the selection of a length of an end portion of the stapling element, and in the selection of a length of a bridging portion of the stapling element.

Figure 3D:
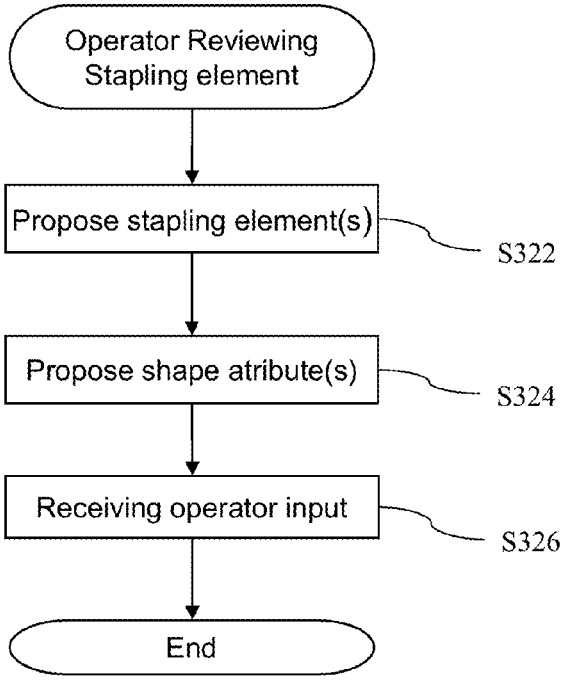
FIG. 3D is a flow chart for an operator reviewing of a stapling element.

In step S306, an operator review is carried out as is further illustrated in FIG. 3D. The operator review comprises steps S322, S324 and S326. In step S322, a number of user selectable stapling elements is proposed to an operator for review. For example, three selectable stapling elements are presented to an operator. Furthermore, in step S324, a number of configurable shape attribute(s) of the stapling element type is presented to an operator for review, such as a length of a bridging portion of the stapling element. In step S326, an operator input regarding the user selectable stapling elements and/or configurable shape attribute of the stapling element type is received and processed.

As shown in FIG. 3B, in step S308, a wire deforming program is determined. The wire deforming program is determined based on the selection of at least one shape attribute of the stapling element. The wire deforming program contains a number of manufacturing steps for deforming the wire in order to form the stapling element, which is selected in step S326.

In step S310, a stapling element is formed according to the wire deforming program of step S308 by bending the wire at a selected number of positions along the wire and cutting the wire. Finally, in step S312, the stapling element of step S310 is applied to the stack of sheets, thereby retaining the stack of sheets. In an embodiment, a position of the stapling element with respect to the stack of sheets 43 may be configurable.

Figure 4:
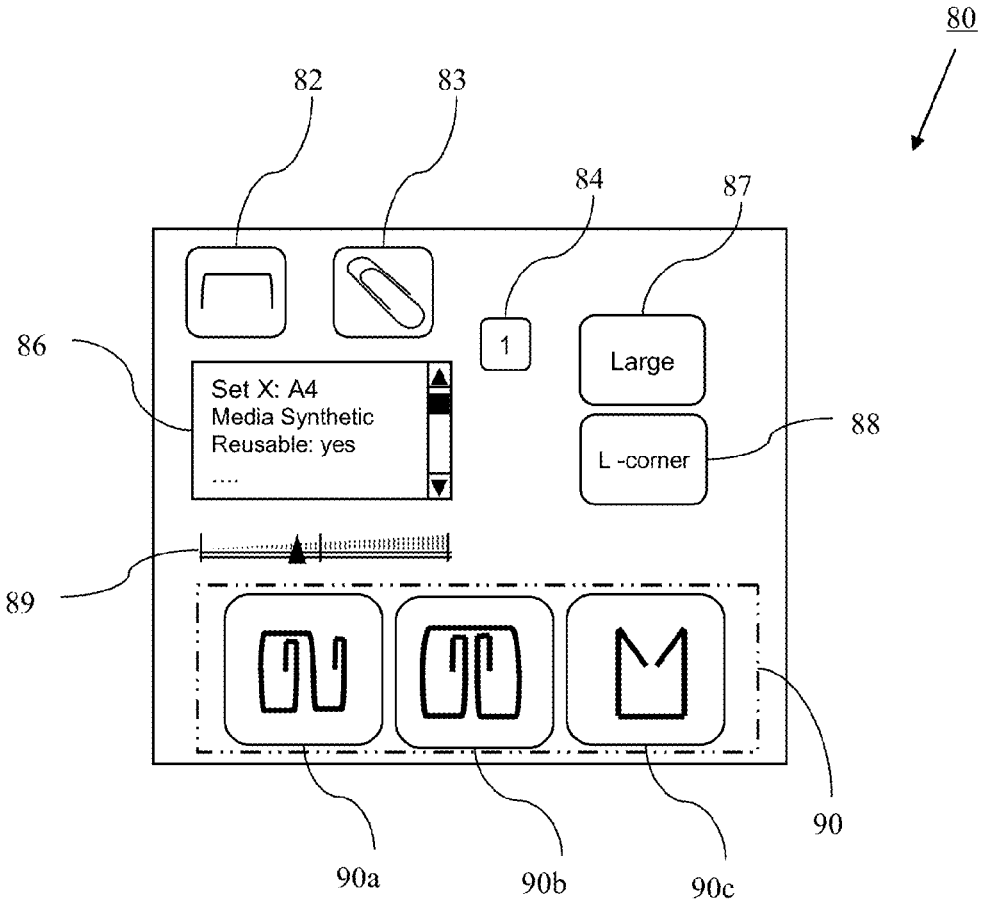
FIG. 4 shows a user interface for performing steps of the method shown in FIGS. 3A-3D.

FIG. 4 shows a user interface for performing steps of the method. The steps, which are referred to, are shown in the flow diagrams of FIGS. 3A-3D. An operator review is performed for selecting the retaining element type (S201, S301) and for selecting at least one configurable shape attribute of the retaining element (S226 for a clip element and S326 for a stapling element, respectively).

The user interface 80 comprises a stapling element selection button 82 and a clip element selection button 83. The operator is able to select one of the stapling element type and the clip element type (S201, S301). Information regarding the stack of sheets is presented in a field 86. For example, the number of sheets of the stack of sheets is presented, the size of the sheets (A4, A3, etc.) and the type of sheet material (paper, reusable sheet, etc.). The number of retaining elements to be applied is shown in field 84. Usually, the number of retaining elements to be applied is 1. The size of the retaining element is indicated in field 87 (S224, S324) and the position of the retaining element with respect to the stack of sheets is indicated in field 88. The size of the retaining element and the position of the retaining element may be adjusted by the operator. The clamping force of the retaining element is indicated by slider UI-element 89, which clamping force may be adjusted higher or lower by operator input as indicated by the slider (S203). In field 90, three user selectable retaining elements 90*a*, 90*b*, 90*c* are presented (S222, S322), which provide the clamping force as indicated in field 89. The operator is able to select one of the retaining elements 90*a*, 90*b*, 90*c* based upon his preferences or requirements (S226, S326). The selected retaining element is formed on-demand (S210, S310) and subsequently applied in order to retain the stack of sheets (S212, S312).

FIGS. 5A-5D show several subsequent phases of a retaining element forming step according to an embodiment of the present invention. The phases of the retaining element forming step can be used in a wire deforming unit 74 of a post processing unit of the present invention.

Figure 5A:
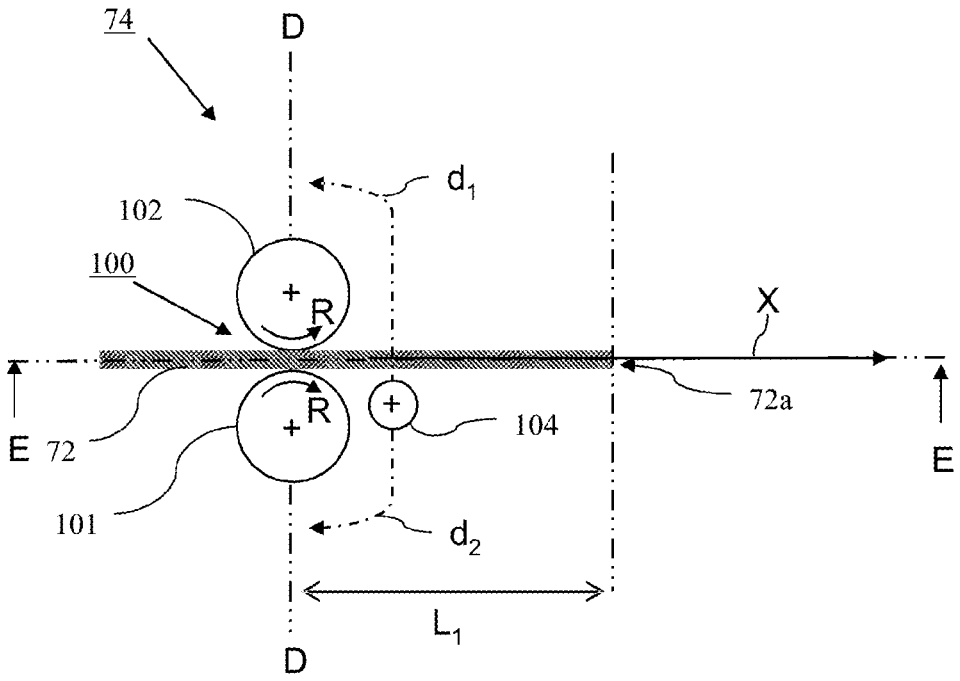
FIGS. 5A-5D show several sub sequent phases of a retaining element forming step in a wire deforming unit according to an embodiment of the present invention.

In FIG. 5A, a first phase is shown. The wire deforming unit 74 comprises a wire transport pinch 100, which is provided by a first wire transport roller 101 and a second wire transport roller 102, and a wire deforming element 104. A wire 72 is supplied from the wire source (not shown), which has the form of a wire roll supported on a reel, wherein the wire 72 has a varying radius of curvature. Prior to the first phase shown in FIG. 5A, depending on the actual curvature of the wire, the wire 72 may be straightened (e.g. in a straight duct) before entering the wire transport pinch 100. The wire deforming element 104 may be moved along a wire deforming path as indicated by arrows $d_1$ and $d_2$. In the first phase, the wire deforming element 104 is arranged in a first position adjacent to the first wire transport roller 101. The transport rollers 101, 102 are rotated in a direction, as indicated by arrows R, in order to transport the wire 72 through the wire transport pinch 100 in a main transport direction X. A first end of the wire 72*a* is moved in the direction X over a distance $L_1$ with respect to the wire transport pinch 100.

Figure 5B:
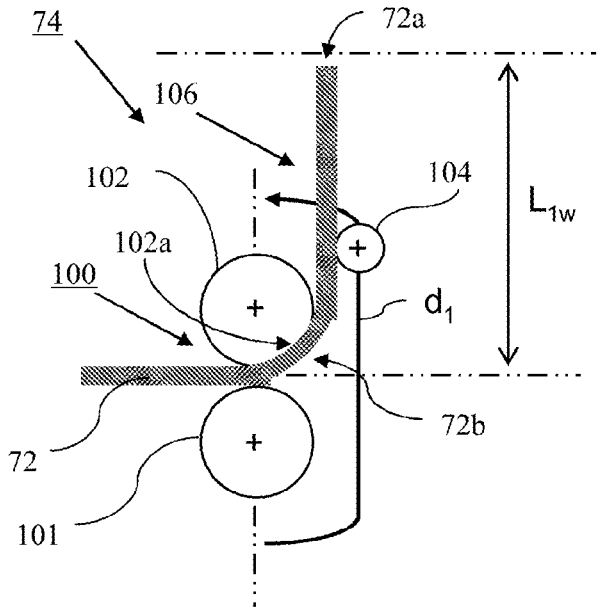

FIG. 5B shows a second phase. In the second phase, the wire deforming element 104 is moved in the direction $d_1$ to a second position adjacent to the second wire transport roller 102. As a result, the wire 72 is deformed over an outer surface of the second wire transport roller 102*a*, whereby a first bend 72*b* has been formed in the wire 72 having an angle of about 90 degrees. An end portion of the wire 106 now has a first length of the wire $L_{1w}$ between the first end of the wire 72*a* and the first bend of the wire 72*b*. The first length $L_{1w}$ is somewhat smaller than the distance $L_1$ depending on the bending angle of the first bend 72*b*. A relation between distance $L_1$ and first length $L_{1w}$ is taken as a wire deforming constraint for determining a wire deforming program (as illustrated by input of wire deforming constraints In 2 in FIG. 2 and FIG. 3).

Figure 5C:
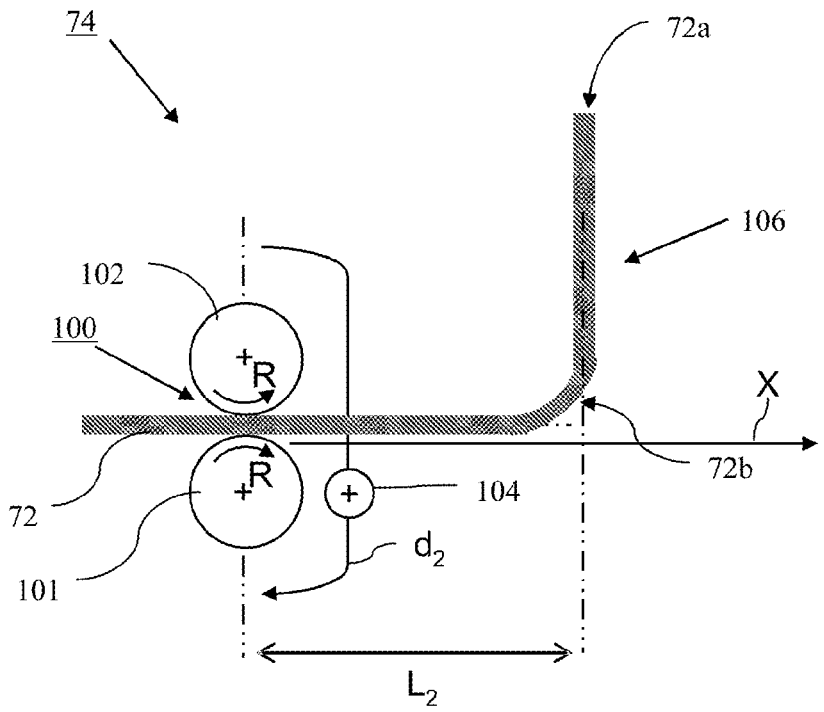

FIG. 5C shows a third phase. In the third phase, the wire deforming element 104 is moved to the first position adjacent to the first wire transport roller 101, and subsequently, the wire 72 is transported by the wire transport pinch 100 in a main transport direction X in order to move the first bend of the wire 72*b* over a distance $L_2$ with respect to the wire transport pinch 100.

Figure 5D:
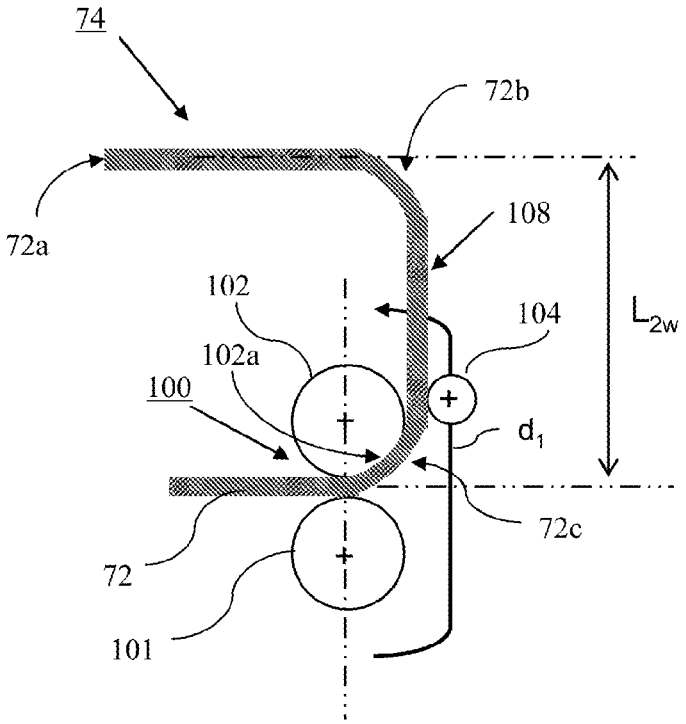

FIG. 5D shows a fourth phase. In the fourth phase, a second bend 72*c* has been formed in the wire 72 by moving the wire deforming element along the direction $d_1$ to the second position adjacent to the second wire transport roller 102. A second portion of the wire 108 has a second length of the wire $L_{2w}$ between the first bend of the wire 72*b* and the second bend of the wire 72*c*. The second length $L_{2w}$ is somewhat smaller than the distance $L_2$. The second bend 72*c* is formed in the same direction as the bending direction of the first bend 72*b*.

FIGS. 6A-6D shows several subsequent phases of a retaining element forming step according to another embodiment of the present invention.

Figure 6A:
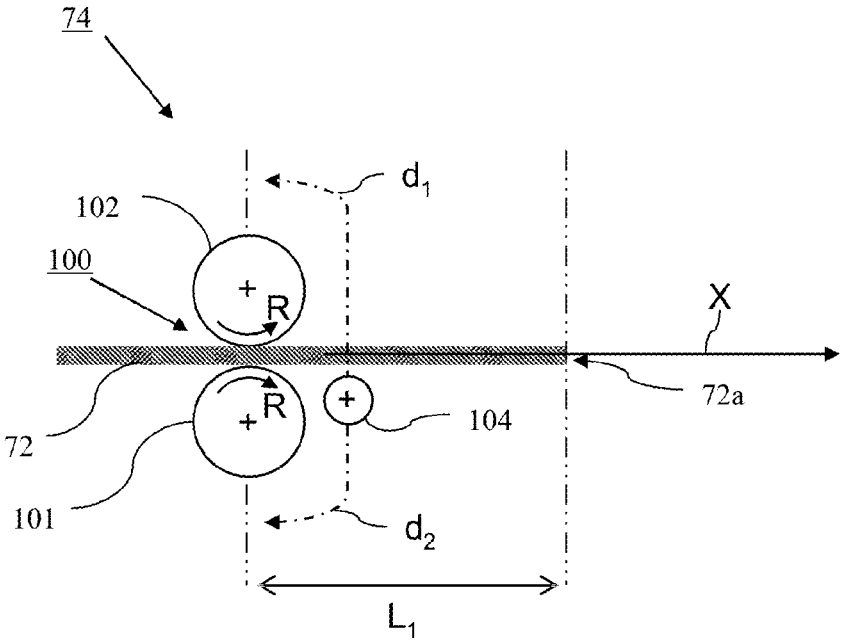
FIGS. 6A-6D show several sub sequent phases of a retaining element forming step in a wire deforming unit according to another embodiment of the present invention.
Figure 6B:
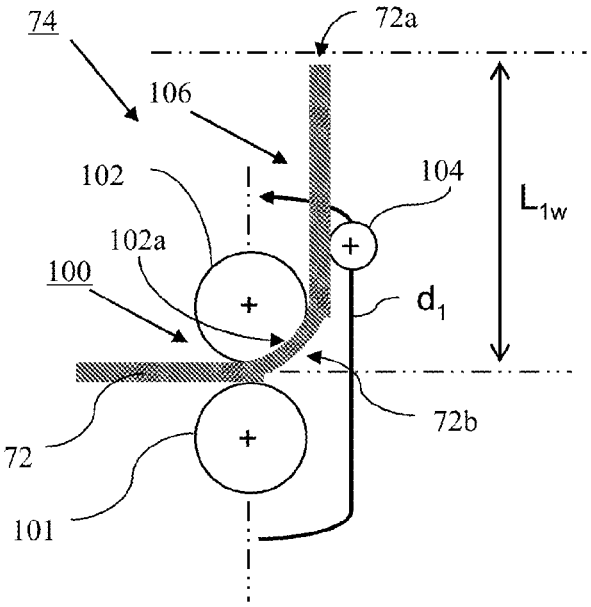

In FIG. 6A, a first phase is shown, which is the same as the first phase shown in FIG. 5A. In FIG. 6B, a second phase is shown, which is the same as the second phase shown in FIG. 5B.

Figure 6C:
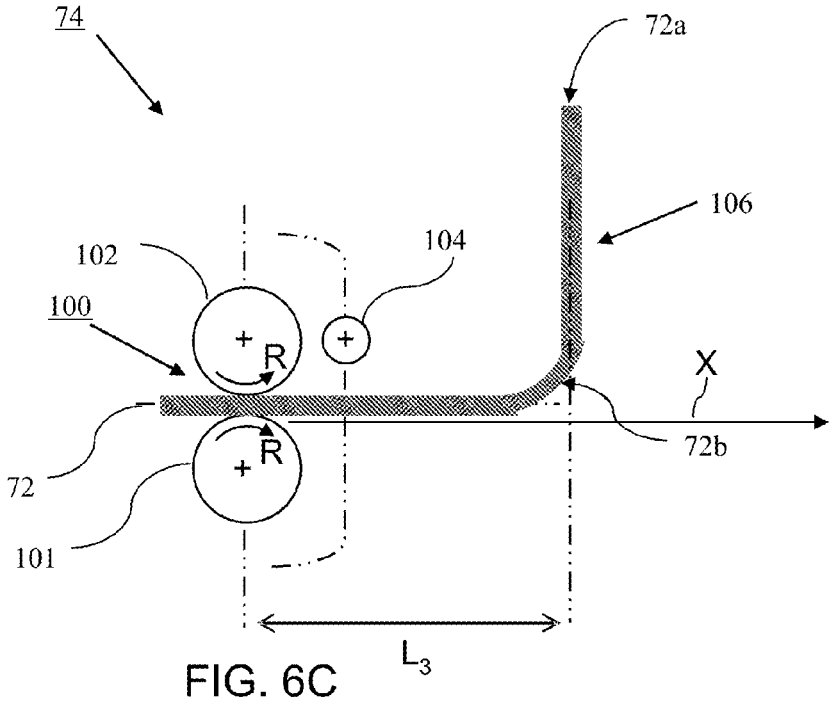

FIG. 6C shows a third phase of the embodiment, which third phase is carried out after the second phase shown in FIG. 6B. In the third phase, the transport rollers 101, 102 are rotated in a direction, as indicated by arrows R, in order to transport the wire 72 through the wire transport pinch 100 in a main transport direction X. The first bend of the wire 72*b* is moved over a distance $L_3$ with respect to the wire transport pinch 100. During the transport of the wire, the wire deforming element 104 is temporarily removed from the plane of the wire deforming path (indicated by arrow $d_1$, $d_2$). Finally, the wire deforming element 104 is repositioned in the second position adjacent to the second wire transport roller 102. In this way, the wire deforming element 104 does not obstruct the transport of the wire 72 in the direction X.

Figure 6D:
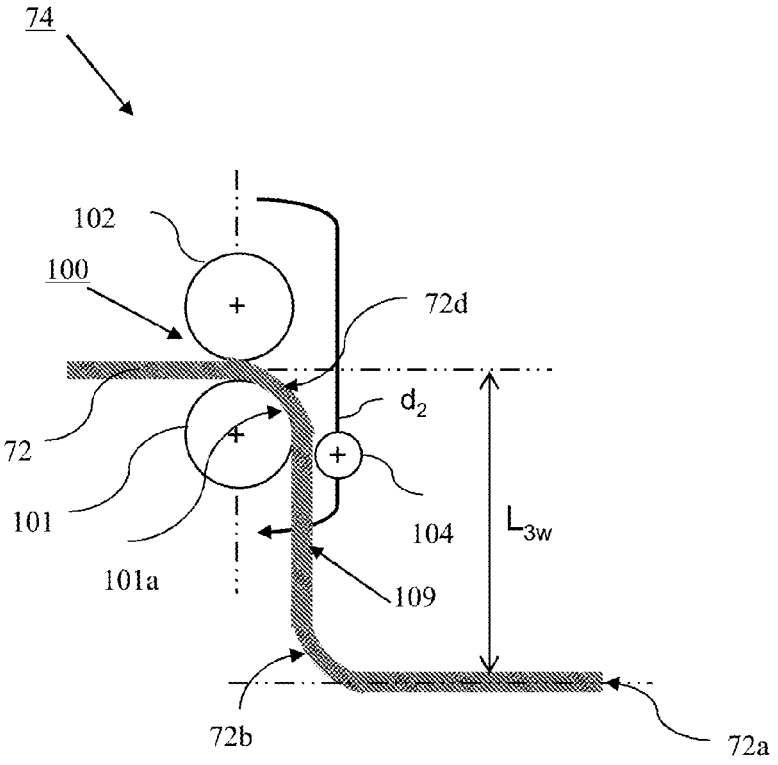

FIG. 6D shows a fourth phase of the embodiment. In the fourth phase, a third bend 72*d* is formed in the wire 72 by moving the wire deforming element along the direction $d_2$ to the first position adjacent to the first wire transport roller 101. The wire 72 has been deformed over the outer surface of the first wire transport roller 101*a*, thereby forming the third bend 72*d* having an angle of 90 degrees. The third bend 72*d* is formed in a direction opposite of the bending direction of the first bend 72*b*. A second portion of the wire 109 has a second length of the wire $L_{3w}$ between the first bend of the wire 72*b* and the third bend of the wire 72*d*.

In the embodiments shown in FIGS. 5A-5D and FIGS. 6A-6D, each of the transport rollers 101, 102 is used as a bend forming element, wherein the outer surface of transport rollers 101*a*, 102*b* defines the shape of the wire bend. Alternatively, a bend forming element having a suitably shaped outer surface may be provided downstream of the transport pinch. The bend forming element in cooperation with a wire deforming element 104 may be used in a wire deforming step in order to provide wire bend having a different shape than a shape provided by an outer surface of a transport roller.

Figure 7A:
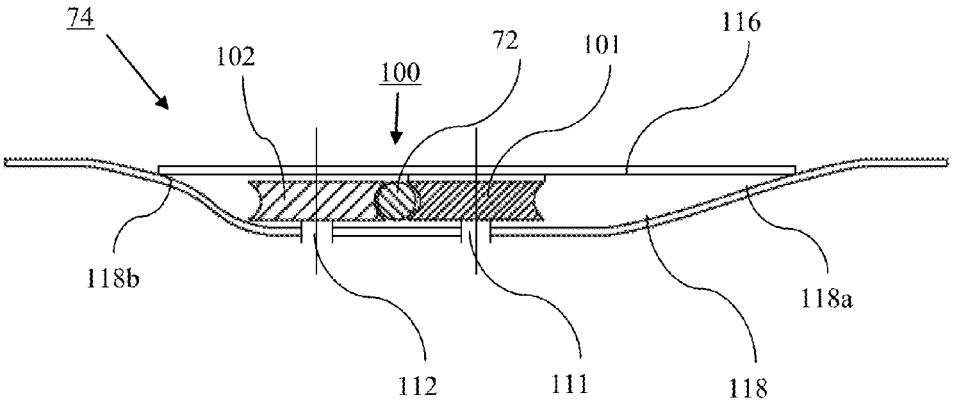
FIG. 7A illustrates a cross section view of the wire deforming unit shown in FIG. 5A along the line D-D.

FIG. 7A illustrates a cross section view of the wire deforming unit shown in FIG. 5A along the line D-D. In FIG. 7A, the cross section view of the wire deforming unit 74 is perpendicular to the main transport direction X of the wire 72. FIG. 7A shows the transport pinch 100, which is provided by the first wire transport roller 101 and the second wire transport roller 102. The first wire transport roller 101 is rotatably connected to a first axis 111 and the second wire transport roller 102 is rotatably connected to a second axis 112. Further, a first plate 116 is arranged at a first side of both wire transport rollers 101, 102 and a second plate 118 is arranged at a second side of both wire transport rollers 101, 102. The second plate 118 is curved at a first end 118*a* and a second end 118*b* and touches at both ends the first plate 116.

Figure 7B:
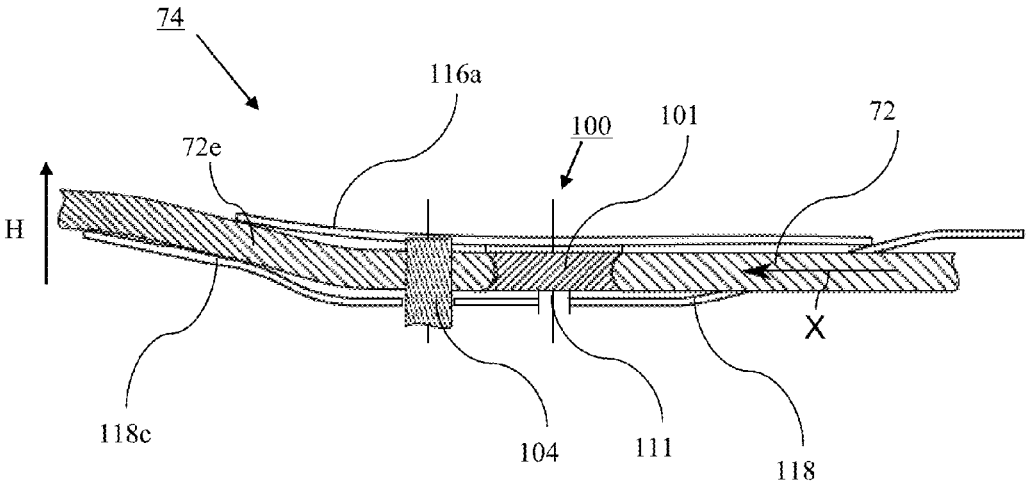
FIG. 7B illustrates a cross section view of the wire deforming unit shown in FIG. 5A along the line E-E.

FIG. 7B illustrates a cross section view of the wire deforming unit shown in FIG. 5A along the line E-E. In FIG. 7B, the cross view of the wire deforming unit is along the main transport direction X of wire 72. Downstream of the wire transport pinch 100 and downstream of the wire deforming element 104, the wire is elastically bent by the second plate 118 and the first plate 116 in a direction as indicated by arrow H. An end portion of the second plate 118*c* is curved upwards and functions together with an end portion of the first plate 116*a* as a spring to elastically bend the wire portion 72*e* in the direction H. It should be noted that the part of the retaining element, which has already been formed, is not confined by a position of the transport rollers and a position of a wire deforming element, because the wire portion 72*e* is moved out of the plane of the transport pinch 100 and the wire deforming element 104. The advantage is that a retaining element, having parts which at least partially overlap each other, can easily be formed.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for retaining a stack of sheets in a post-processing unit, the method comprising the steps of:

a) forming a stack of sheets;

b) providing a wire from a wire source, the wire being plastically-elastically deformable;

c) selecting a type of retaining element from a group comprising a clip element and a stapling element;

d) determining a wire deforming program for forming a retaining element based on the type of retaining element selected in step c);

e) forming the retaining element according to the wire deforming program by bending the wire at a number of positions along the wire and cutting the wire; and f) applying the formed retaining element to the stack of sheets, thereby retaining the stack of sheets, wherein the clip element is arranged for clamping the stack of sheets without protruding into the stack of sheets, and wherein the stapling element is arranged for stapling the stack of sheets by protruding into the stack of sheets.

2. The method according to claim 1, wherein step d) further comprises the step of basing the wire deforming program on a thickness of the stack of sheets formed in step a).

3. The method according to claim 1, wherein, when the retaining element selected is the clip element, step d) further comprises the step of selecting a shape attribute of the clip element based on the stack of sheets formed in step a) and based on a predetermined clamping force, wherein the shape attribute of the clip element comprises at least one of a number of bends, a bending angle of each of the number of bends and a length of the wire between each two adjacent bends along the wire.

4. The method according to claim 3, wherein step d) further comprises the step of selecting a first length of the wire between two adjacent bends based on a thickness of the stack of sheets formed in step a).

5. The method according to claim 1, wherein, when the retaining element selected is the stapling element, step d) further comprises the step of selecting a shape attribute of the stapling element based on a thickness of the stack of sheets formed in step a), wherein the shape attribute of the stapling element comprises at least one of a length of the wire between two adjacent bends along the wire and a length of the wire between an end of the wire and an adjacent bend along the wire.

6. The method according to claim 1, wherein step c) further comprises the step of selecting the type of retaining element based on an operator input.

7. The method according to claim 1, wherein step d) further comprises the step of selecting a shape attribute of the retaining element based on an operator input indicating a configurable shape attribute.

8. The method according to claim 1, wherein step e) further comprises the step of transporting the wire in a main transport direction and bending the wire with respect to the main transport direction over an outer surface of a bend forming element, thereby providing a first bend in a first bend forming direction.

9. The method according to claim 8, wherein step e) further comprises the step of temporarily bending a portion of the wire, which portion is downstream of the bend forming element with respect to the main transport direction, in a direction having an angle with respect to a plane defined by the main transport direction and the first bend forming direction.

10. The method according to claim 1, wherein the stack of sheets formed in step a) comprises at least one reusable sheet.

11. An apparatus for retaining a stack of sheets, the apparatus comprising:

a) a stack forming unit for forming a stack of sheets;

b) a wire source for storing a wire, the wire being plastically-elastically deformable;

c) a selection unit for selecting a type of retaining element from a group comprising a clip element and a stapling element;

d) a wire deforming unit configured for, in operation, forming a retaining element of the selected type of retaining element by bending and cutting the wire according to a wire deforming program;

e) a retaining unit for applying the formed retaining element to the stack of sheets; and f) a control unit for controlling the stack forming unit, the selection unit, the wire deforming unit and the retaining unit for retaining the stack of sheets, wherein the control unit determines the wire deforming program for the wire deforming unit, wherein the clip element is arranged for clamping the stack of sheets without protruding into the stack of sheets, and wherein the stapling element is arranged for stapling the stack of sheets by protruding into the stack of sheets.

12. The apparatus according to claim 11, wherein the apparatus further comprises a sensor for determining a thickness of the stack of sheets and wherein the control unit determines the wire deforming program based on a sensor signal provided by the sensor to the control unit indicating the thickness of the stack of sheets.

13. The apparatus according to claim 11, wherein the apparatus further comprises a user interface comprising a previewing device for indicating to an operator at least one of a user selectable type of retaining element and a configurable shape attribute of the retaining element and an input device for receiving at least one of an operator input regarding the type of retaining element and an operator input regarding the configurable shape attribute of the retaining element.

14. The apparatus according to claim 11, wherein the wire deforming unit comprises a transport pinch, comprising two transport rollers, for transporting the wire in a main transport direction, and a wire deforming element for bending the wire over an outer surface of one of the two transport rollers in a first bend forming direction and over an outer surface of the other one of the two transport rollers in a second bend forming direction.

15. The apparatus according to claim 11, wherein the apparatus further comprises a detector configured to detect the stacking of a reusable sheet in the stack forming unit, wherein the detector is configured, in case a reusable sheet is detected, to send a signal to the selection unit, upon which signal the selection unit automatically selects the clip element type.

* * * * *